US009076622B2

(12) United States Patent
Lanning et al.

(10) Patent No.: US 9,076,622 B2
(45) Date of Patent: Jul. 7, 2015

(54) TRIP UNIT WITH CAPTIVE TRIP BAR

(71) Applicant: Eaton Corporation, Cleveland, OH (US)

(72) Inventors: Scott Ray Lanning, Conway, PA (US); Edward Anthony Prince, Aliquippa, PA (US); Nathan James Weister, Darlington, PA (US); Thomas Mark Whalen, Cranberry Township, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/215,408

(22) Filed: Mar. 17, 2014

(65) Prior Publication Data

US 2014/0320242 A1 Oct. 30, 2014

Related U.S. Application Data

(60) Provisional application No. 61/816,940, filed on Apr. 29, 2013.

(51) Int. Cl.

| | |
|---|---|
| ***H01H 9/00*** | (2006.01) |
| ***H01H 71/50*** | (2006.01) |
| ***H01H 71/02*** | (2006.01) |
| *H01H 71/12* | (2006.01) |

(52) U.S. Cl.

CPC ..... *H01H 71/505* (2013.01); *H01H 71/0214* (2013.01); *H01H 71/0228* (2013.01); *H01H 71/123* (2013.01); *H01H 2009/0088* (2013.01); *H01H 2071/0242* (2013.01)

(58) Field of Classification Search

CPC ..... H01H 71/0214; H01H 71/505; H01H 71/0228; H01H 2009/0088; H01H 2071/0242; H01H 71/123

USPC ..... 335/167–175; 200/293; 337/50, 112

See application file for complete search history.

(56) References Cited

U.S. PATENT DOCUMENTS

| | | | | |
|---|---|---|---|---|
| 3,211,860 | A | 10/1965 | Stephenson, Jr. et al. | |
| 5,278,373 | A | 1/1994 | Faber et al. | |
| 5,982,258 | A * | 11/1999 | Baginski et al. | 335/175 |
| 6,144,271 | A * | 11/2000 | Mueller et al. | 335/202 |
| 6,853,279 | B1 | 2/2005 | Puskar et al. | |
| 7,911,298 | B2 * | 3/2011 | Carlino et al. | 335/18 |
| 2011/0169599 | A1 * | 7/2011 | Darr et al. | 337/143 |

OTHER PUBLICATIONS

European Patent Office, "International Search Report and Written Opinion", 9 pp., Aug. 8, 2014.

* cited by examiner

*Primary Examiner* — Bernard Rojas

(74) *Attorney, Agent, or Firm* — Eckert Seamans Cherin & Mellott, LLC; David C. Jenkins

(57) ABSTRACT

A trip unit wherein one sidewall of a trip unit housing assembly captivates a trip bar is provided. A captivation assembly is coupled, or directly coupled, to a trip unit housing assembly, thereby limiting tolerance buildup. The captivation assembly includes a trip bar bearing cap having a stop feature, thereby limiting tolerance buildup. The trip bar includes a radial stop paddle having hemispherical protrusions structured to contact the trip unit housing, thereby limiting tolerance buildup. The captivation assembly elements are incorporated into the trip unit housing assembly and captivates the trip bar in all but one axis, thereby limiting tolerance buildup and improving repeatability.

18 Claims, 9 Drawing Sheets

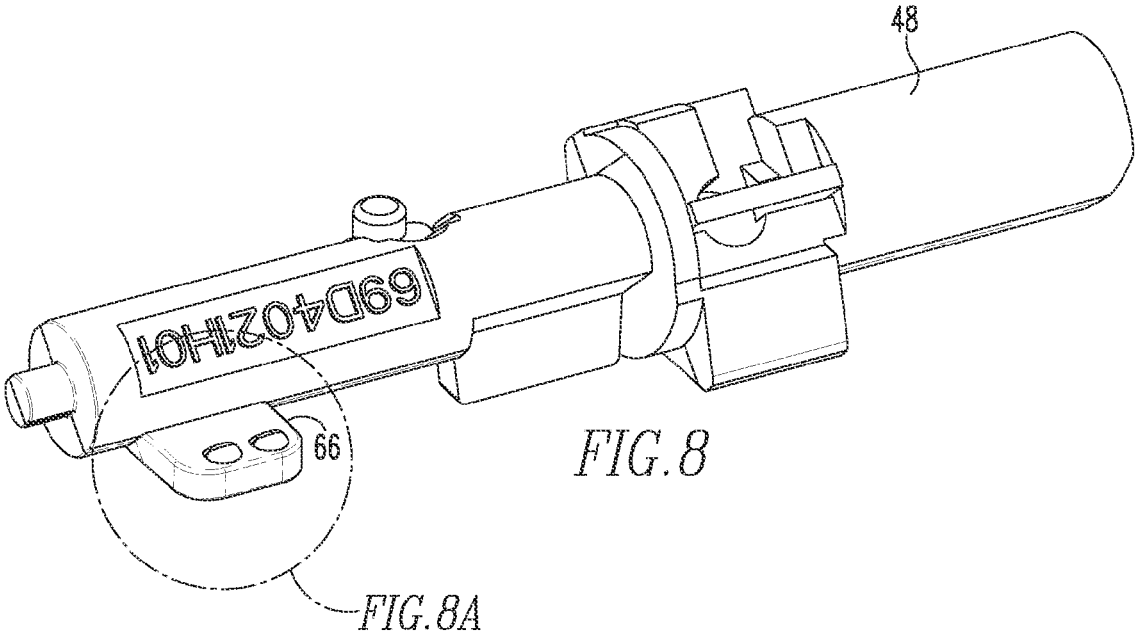
FIG.8
FIG.8A
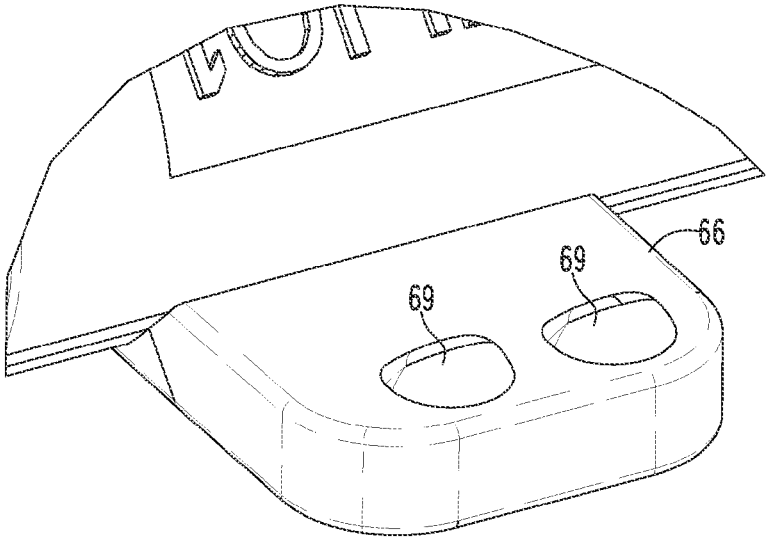
FIG.8A

TRIP UNIT WITH CAPTIVE TRIP BAR

CROSS REFERENCE TO RELATED APPLICATION

This application claims priority to U.S. Provisional Patent Application Ser. No. 61/816,940, filed Apr. 29, 2013 entitled TRIP UNIT WITH CAPTIVE TRIP BAR.

BACKGROUND OF THE INVENTION

1. Field of the Invention

This invention relates to electrical switching apparatus and, more particularly, to circuit breaker trip units.

2. Background Information

Circuit breakers and circuit breaker trip units are well known in the art. Resetting of a circuit breaker (e.g., through the operating handle and operating mechanism thereof) is also accomplished in a manner well known in the art. Generally, a circuit breaker includes an operating mechanism structured to move a number of separable contacts between an open, first position and a closed, second position. The operating mechanism may be actuated manually or by the trip unit.

The trip unit includes an over-current sensor, a trip actuator, and a trip bar. Generally, the over-current sensor is structured to detect an over-current condition in the conductors of the circuit breaker. The over-current sensor may be a mechanical device, an electrical device, or a combination thereof. In an exemplary embodiment, the over-current sensor produces an electronic signal upon detecting an over-current condition. The trip actuator is an electro-mechanical apparatus that operates various parts of the trip unit after being activated by the trip signal. That is, the trip actuator receives the signal from the over-current sensor and produces a mechanical motion. In an exemplary embodiment, the trip actuator includes an elongated plunger that moves longitudinally. The trip actuator acts upon the trip bar.

The trip bar is an elongated generally cylindrical member structured to rotate about an axis of rotation. The trip bar includes a number of extensions, e.g. radial extensions and tangential extensions, that interact with other components of the trip unit and circuit breaker. For example, the trip bar is coupled to the circuit breaker operating mechanism and, when actuated by the trip actuator, rotation of the trip bar causes the operating mechanism to move the contacts from the second, closed position to the first, open position. That is, the trip bar is part of the linkage that allows the trip unit to trip the circuit breaker.

A trip unit also includes a housing assembly that substantially encloses the other trip unit components. The circuit breaker housing assembly includes a cavity into which the trip unit is disposed. That is, the circuit breaker housing assembly cavity is sized to correspond to the trip unit housing assembly. The trip unit housing assembly is divided into two halves, each half including a planar member with a peripheral, generally perpendicular depending sidewall. Thus, when the two halves are brought together, the housing assembly defines an enclosed space for the other components.

This design has disadvantages in that alignment and tolerance error allowed the trip bar to be pinched or misaligned. That is, for example, as shown in U.S. Pat. No. 6,853,279, the trip bar is disposed in a saddle extending from one housing assembly sidewall. A trip detection circuit is disposed over the trip bar. Then the other housing assembly sidewall is coupled to the first housing assembly sidewall, sandwiching the components there between. In this configuration, the trip unit housing assembly must define multiple spaces for the internal components, each of which have tolerances built into the separate housing assembly sidewalls. The requirement of multiple tolerances can allow the trip bar to have too little or too much space. Too much tolerance allows the trip bar to be loose and allows for "rattle." If the trip bar is loose, there may be either too much "latch bite," which requires more force to trip, or, too little "latch bite," which promotes premature tripping. Further, too many tolerances (tolerance build up/stack up) also result in inconsistent latch loading and yield issues for accessories.

SUMMARY OF THE INVENTION

At least one embodiment of the disclosed and claimed concept provides a trip unit wherein one sidewall of the housing assembly captivates the trip bar. That is, the housing assembly includes a captivation assembly disposed on a single sidewall. In this configuration, the trip bar is subject to only the tolerances built into the captivation assembly.

In an exemplary embodiment, the trip unit includes a housing assembly having a first generally planar sidewall, a captivation assembly disposed only on the first sidewall, an elongated trip bar and wherein the trip bar is captivated by the captivation assembly.

Thus, it is the shape and the configuration of the captivation assembly that solves the stated problems such as, but not limited to, tolerance buildup.

BRIEF DESCRIPTION OF THE DRAWINGS

A full understanding of the invention can be gained from the following description of the preferred embodiments when read in conjunction with the accompanying drawings in which:

FIG. 8 is another isometric view of a trip bar. FIG. 8A is a detail view of a trip bar paddle.

DESCRIPTION OF THE PREFERRED EMBODIMENTS

Figure 1:
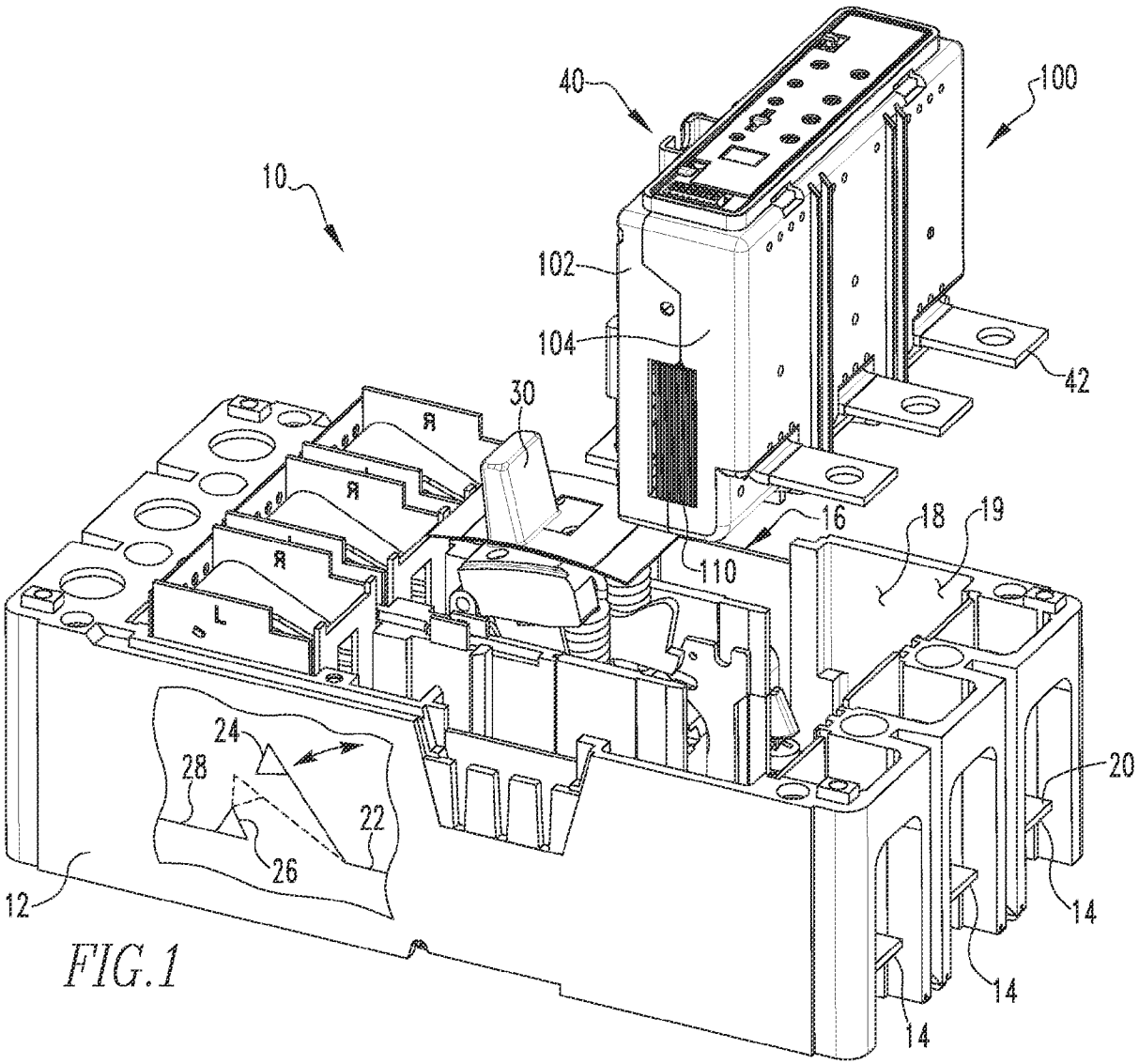
FIG. 1 is an exploded isometric view of a circuit breaker.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g. an axle first end being coupled to a first wheel means that the specific portion of the first element is disposed closer to the second element than the other portions thereof.

As used herein, the statement that two or more parts or components "engage" one another shall mean that the parts exert a force against one another either directly or through one or more intermediate parts or components.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit.

As used herein, a "point contact" means that at least one of two contacting elements is generally spherical. That is, when a spherical element contacts another element, the spherical element is engaged, generally, at a single point. Such a configuration reduces tolerance build-up errors that may occur when, for example, flat surfaces engage each other at an angle. Thus, a description of two elements including a point contact means at least one of two contacting elements is generally spherical.

As used herein, a "line contact" means that at least one of two contacting elements is generally cylindrical. Similar to a point contact, a line contact reduces tolerance build-up errors.

As used herein, "captivation" or an element that is "captivated" means that an element or assembly is maintained in a defined space. That is, the element or assembly is generally free to move within a limited range of motion within the defined space. By way of example, a ball bearing in a channel of a circular race is "captivated." That is, the ball bearing is not fixed to the circular race and may move about within the space defined by the channel.

As used herein a "medial axial face" is a surface between an elongated body's two ends that extends generally perpendicular to the longitudinal axis of the body. The medial axial face may define a portion of the body's axial surface. For example, a generally circular rod may have a D-shaped end; that is a longitudinal cutout extending from an axial end of the rod and over 180 degrees. In this configuration, half the rod's axial surface is at the axial end and the other half is a "medial axial face" that is spaced from the axial end. Alternatively, a medial cutout, i.e. a cutout that does not extend to the axial end of a rod creates two "medial axial faces," one at each end of the cutout.

As shown in FIG. 1, and as is known, a circuit breaker 10 includes a housing assembly 12, a conductor assembly 14, an operating mechanism 16 as well as other components. The housing assembly 12, shown without a cover, is made from a non-conductive material and defines an enclosed space 18 wherein the other components may be disposed. The enclosed space 18 includes a cavity 19 for a trip unit 40, or "trip unit cavity 19.". The trip unit cavity is sized to correspond to the trip unit 40, described below. The conductor assembly 14 includes a number of conductive elements 20 that extend through the housing assembly 12. That is, as shown schematically, the number of conductive elements 20 include, but are not limited to, a line bus 22, a movable contact 24, a fixed contact 26, and a load bus 28. The line bus 22 and movable contact 24 are in electrical communication. The fixed contact 26 and the load bus 28 are in electrical communication. The operating mechanism 16 is coupled to each movable contact 24 and is structured to move the movable contacts 24 between an open, first position, wherein the movable contacts 24 are spaced from a fixed contact 26, and, a closed, second position, wherein the movable contacts 24 are directly coupled to, and in electrical communication with, a fixed contact 26. As is known, the circuit breaker 10, in an exemplary embodiment, includes multiple sets of contacts 24, 26.

The operating mechanism 16 includes biasing elements (not shown) such as, but not limited to springs (not shown), that bias the contacts 24, 26 to the open, first position. The operating mechanism 16 includes a handle 30 that is used to move the contacts 24, 26 into the closed second position. The operating mechanism 16 further includes a catch (not shown), or similar device, that maintains the contacts 24, 26 in the second position. The catch, or more generally the operating mechanism 16 is mechanically coupled to the trip unit 40, described below, by a trip latch assembly 17 (shown in part, FIG. 2). When the trip unit 40 detects an over-current condition, a mechanical linkage, such as but not limited to a cam, coupled to the operating mechanism 16 causes the catch to be released thereby causing the bias of the operating mechanism 16 to move the contacts 24, 26 to the open, first position. As is further known, the operating mechanism 16 can also be moved into a "reset" configuration.

Figure 2:
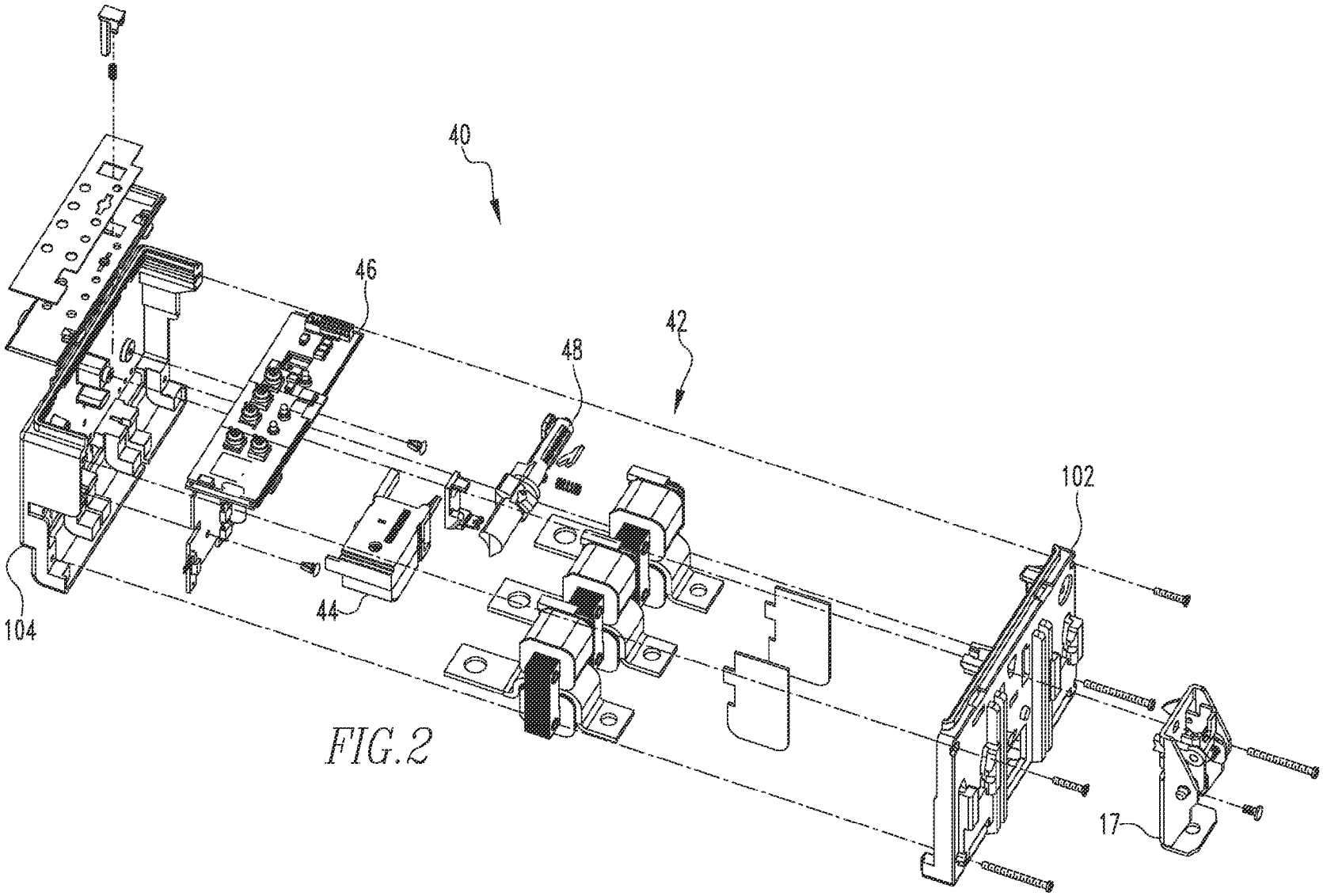
FIG. 2 is an exploded isometric view of a trip unit.
Figure 3:
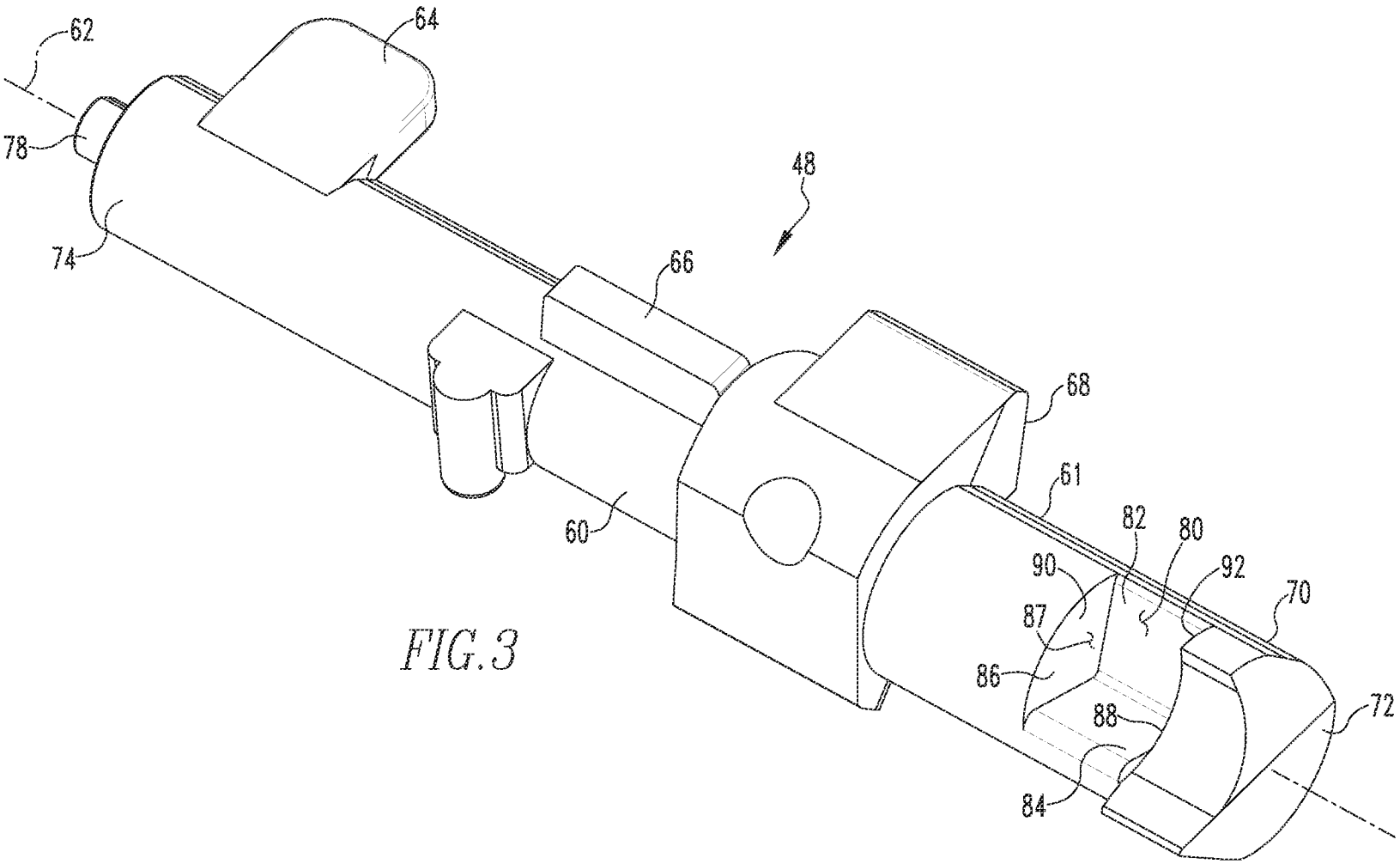
FIG. 3 is an isometric view of a trip bar.
Figure 4:
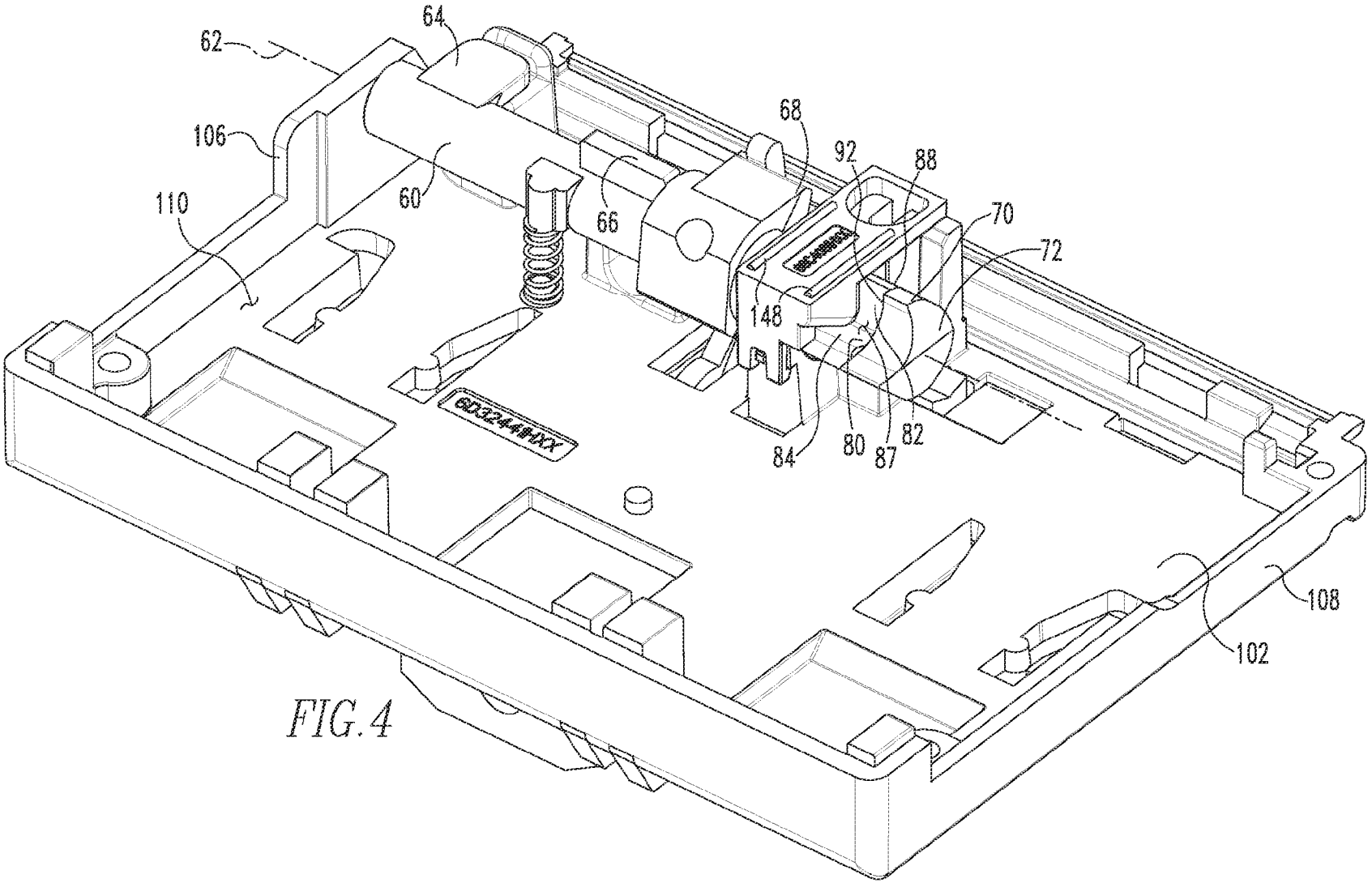
FIG. 4 is a isometric view of a trip unit sidewall with a captivation assembly.
Figure 5:
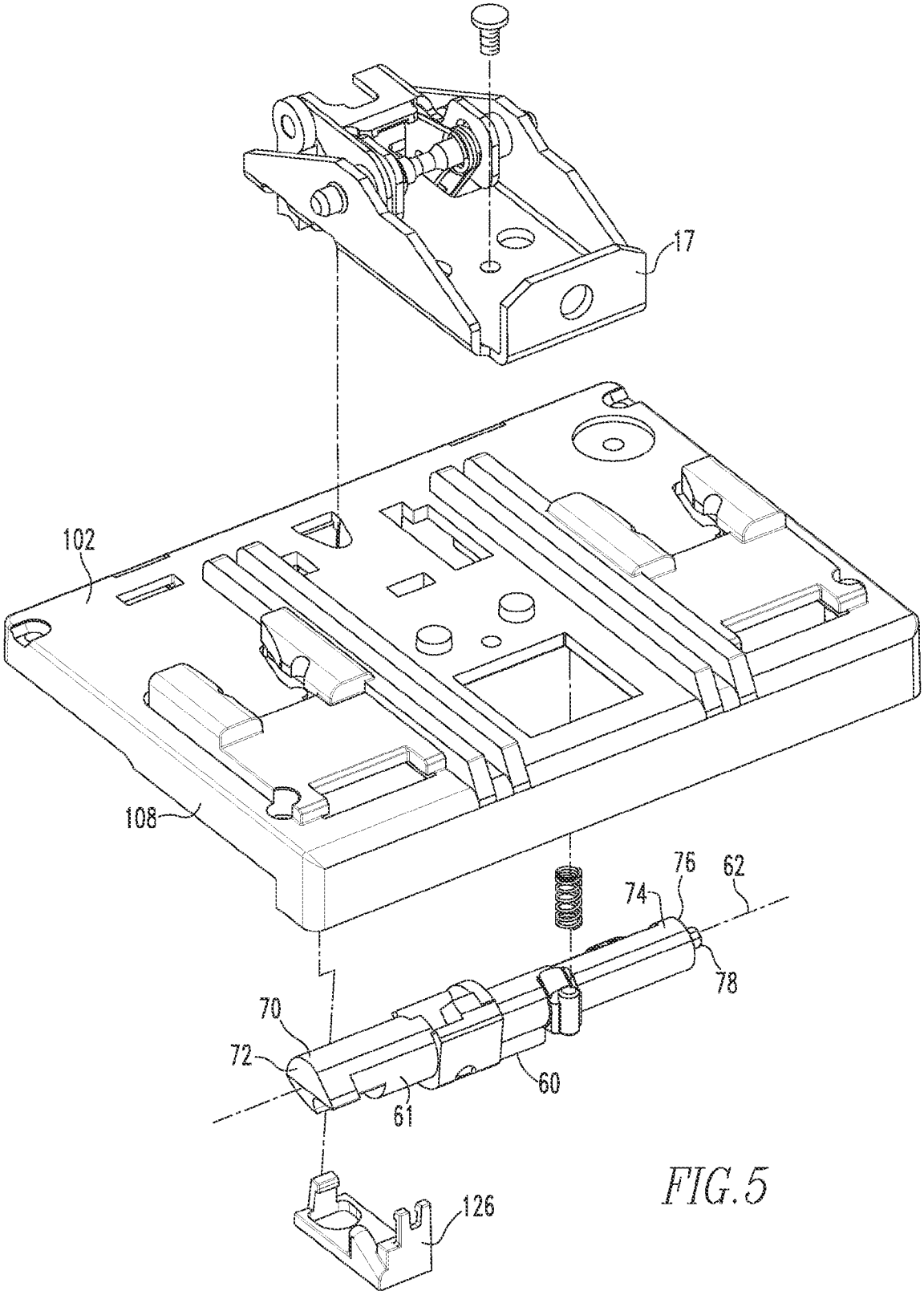
FIG. 5 is an exploded isometric view of a trip unit sidewall with a captivation assembly.

As shown in FIG. 2, the trip unit 40 includes a number of components such as, but not limited to, a number of electrical buses 42, a trip actuator 44, a trip circuit 46, a trip bar 48 and a trip unit housing assembly 100. As is known, the trip circuit 46 is structured to detect an over-current condition in any of the electrical buses 42. The trip circuit 46 produces an electronic signal upon detecting an over-current condition in any of the electrical buses 42. The trip actuator 44 is an electromechanical device that is in electronic communication with the trip circuit 46 and which is structured to produce a mechanical motion in response to receiving a signal indication and over-current condition in any of the electrical buses 42. Generally, the trip actuator 44 is a solenoid type device. When the trip actuator 44 receives a signal to trip, e.g. from the trip circuit 46, a plunger (not shown) extends. The plunger contacts an arm/paddle on the housing of the trip actuator 44. This arm/paddle pivots and contacts the trip bar 48, thus rotating the trip bar 48. The trip bar 48 in turn unlatches the latch and the movable contacts 24 move to the first, open position.

Thus, the trip bar 48 rotates in response to actuation by the trip actuator 44. The trip bar 48, shown in FIGS. 3-7 includes an elongated body 60 having a bearing surface 61 and a longitudinal axis of rotation 62. The trip bar bearing surface 61 is a portion of the trip bar 48 wherein the surface is a generally circular arc extending over an arc of between about 0 to 180 degrees. As set forth below, a longitudinal cutout 80 is disposed along the same length of the trip bar body 60 as the trip bar bearing surface 61, thus the trip bar bearing surface 61 does not extend over a full circle. The trip bar body 60 further includes a number of actuating surfaces including, but not limited to, tangential paddles 64, radial paddles 66, and cam surfaces 68. As shown in FIGS. 8 and 8A, a radial paddle 66 is structured to make a point contact. That is, radial paddle 66 includes a number of hemi-spherical protrusions 69. The hemi-spherical protrusions 69 are structured to make a point contact with the trip unit housing assembly 100. The trip bar body 60 further includes a first end 70, a first end axial face 72, a second end 74 and a second end axial face 76. In an exemplary embodiment, the first and second end axial faces 72, 76 are generally perpendicular to the trip bar axis of rotation 62. The trip bar body first end 70 and first end axial face 72 are shaped to correspond to, and be engaged by, the trip actuator 44. The trip bar body second end 74 includes a generally circular lug 78. The lug 78 extends from the trip bar body second end axial face 76 and is disposed at about the trip bar body axis of rotation 62.

The trip bar body 60 further includes a longitudinal cutout 80 disposed opposite the bearing surface 61. The longitudinal cutout 80 defines a number of longitudinal faces 82, 84 (two shown) and a number of medial axial faces 86, 88. That is, at the location of the cutout 80, there are longitudinal faces 82, 84 that are generally planar surface extending generally parallel to the trip bar body axis of rotation 62. The longitudinal faces 82, 84, in an exemplary embodiment, are generally radial; that is, the longitudinal faces 82, 84 extend generally perpendicular to, and from, the trip bar body axis of rotation 62. It is noted that the cutout 80 may be deeper or more shallow than shown in the exemplary embodiment. Further, the longitudinal faces 82, 84 are not required to be generally radial. The trip bar body longitudinal faces 82, 84 define an arcuate gap 87 with a first cross-sectional area. The cutout further defines two medial axial faces 90, 92. The medial axial faces 90, 92 are identified as the first medial axial face 90 and the second medial axial face 92.

The trip unit housing assembly 100 is sized to correspond to trip unit cavity 19 and is disposed therein. As shown in FIG. 2, the trip unit housing assembly 100 includes a first and second generally planar sidewalls 102, 104. Each generally planar sidewall 102, 104 includes a generally perpendicular, peripheral, depending sidewall, hereinafter identified as a flange 106, 108, as well. As shown in FIG. 1, when the flanges 106, 108 are coupled, the first and second sidewalls 102, 104 define an enclosed space 110. The first sidewall flange 106 includes an opening 109, and in an exemplary embodiment, the flange opening 109 is generally circular. As discussed below, a saddle 124 includes a semi-circular surface 132. The flange opening 109 is generally aligned with the center of the semi-circular surface 132.

Figure 6:
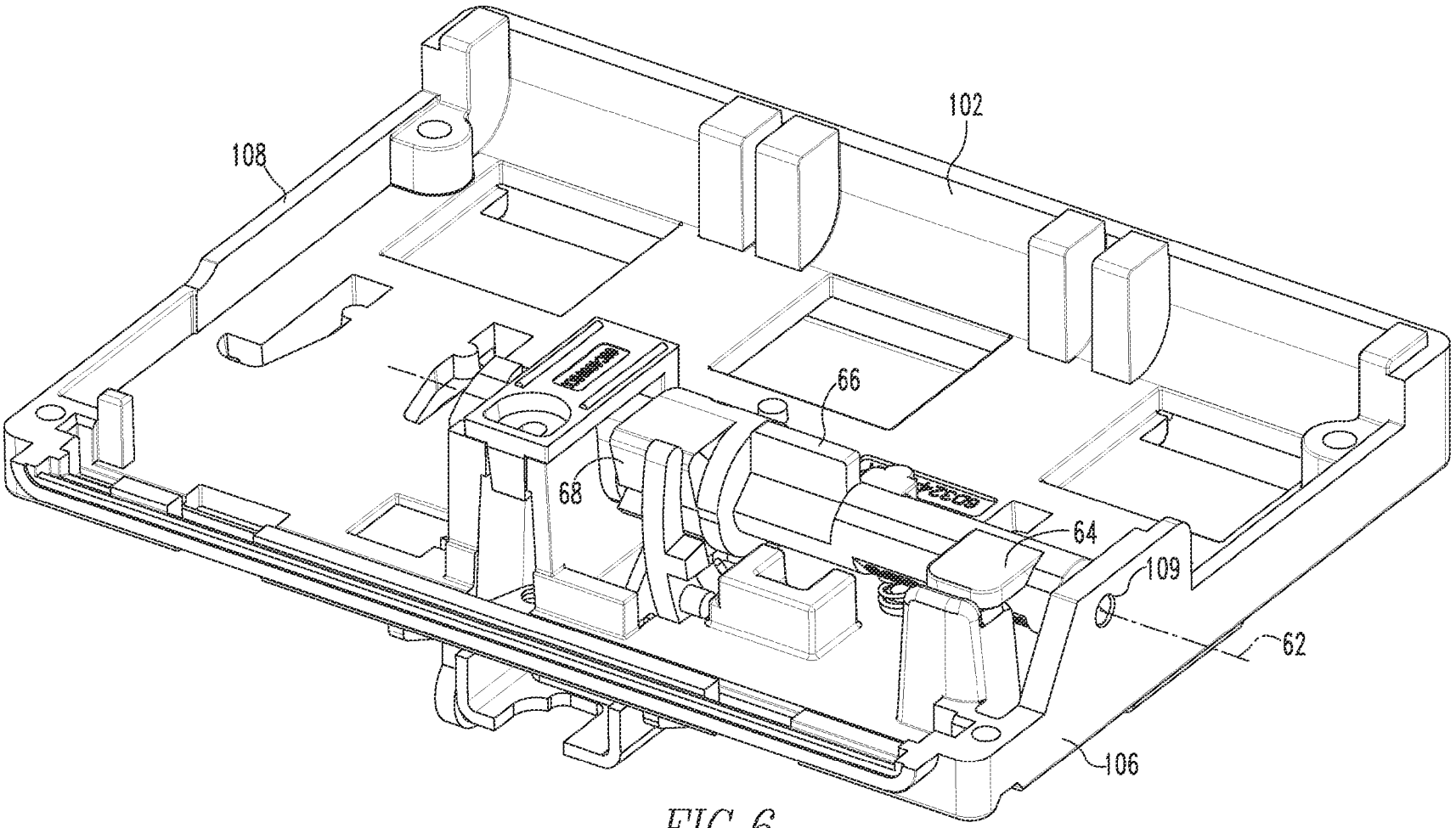
FIG. 6 is another isometric view of a trip unit sidewall with a captivation assembly.
Figure 7:
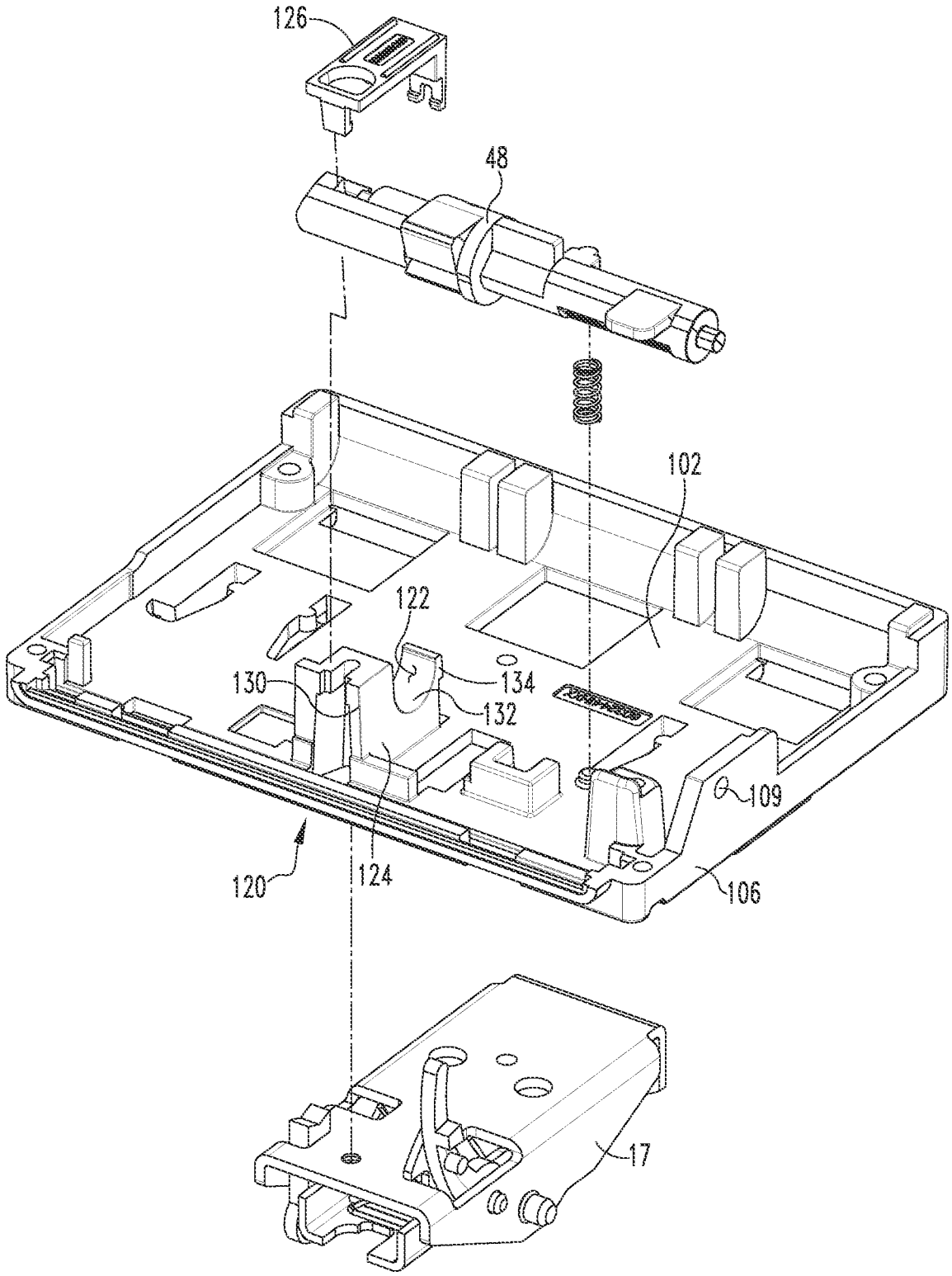
FIG. 7 is another exploded isometric view of a trip unit sidewall with a captivation assembly.
Figure 9:
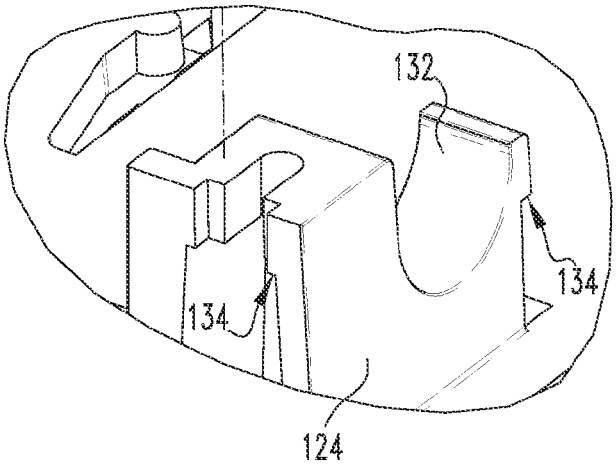
FIG. 9 is a detail isometric view of a saddle.
Figure 10:
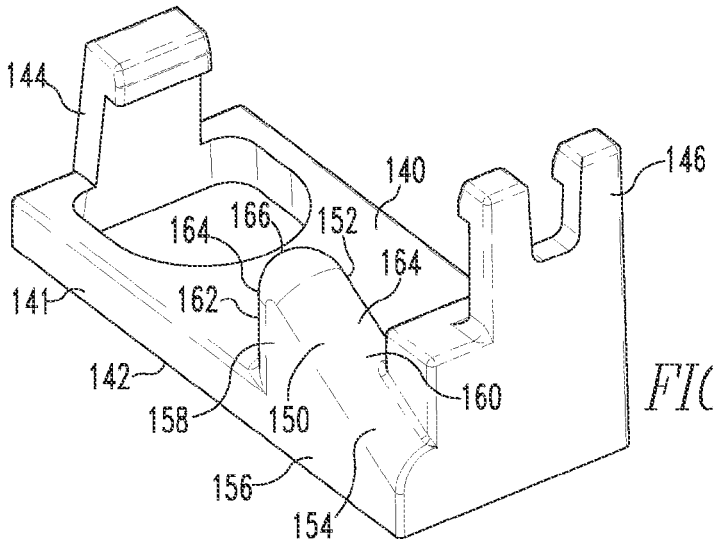
FIG. 10 is a detail isometric view of a bearing cap.

One sidewall 102, 104, and in an exemplary embodiment the first sidewall 102, includes a captivation assembly 120. The captivation assembly 120 defines a captivation space 122. The captivation space 122 is bounded by elements of the captivation assembly 120 and defines a space in which the trip bar 48 is captivated. As set forth below, the trip bar 48 may move freely in the captivation space 122, but the range of motion is limited. The captivation assembly 120 is disposed only on the first sidewall 102. That is, as used herein, a captivation assembly 120 is disposed only on one sidewall 102, 104 means that the captivation assembly 120 does not require any element to be disposed on, or unitary with, the opposing sidewall 102, 104 to create a captivation space. That is, the captivation assembly 120 disposed only on one sidewall 102, 104 is structured to captivate, i.e. create a captivation space 122 without the opposing sidewall 102, 104. It is noted that a trip bar 48 that is merely disposed or resting on one sidewall 102, 104 as shown in FIGS. 6-8 of U.S. Pat. No. 6,853,279 is not "captivated" because the disclosed assembly is not held together until the second sidewall is coupled thereto. That is, the elements of the assembly shown in FIGS. 6-8 of U.S. Pat. No. 6,853,279 are not maintained in the shown configuration until the second sidewall is coupled to the first sidewall. As such, the trip bar 48 is not "maintained in a defined space" as is required to be captivated. Stated alternatively, and as used herein, to be "maintained in a defined space" the elements defining the space must be maintained in a substantially fixed orientation and location relative to each other regardless of orientation.

The captivation assembly 120 includes a saddle 124 and a bearing cap 126. The saddle 124, in an exemplary embodiment, is unitary with the first sidewall 102. The saddle 124 includes a body 130 defining an arcuate, and in an exemplary embodiment a semi-circular surface 132. The saddle body arcuate surface 132 corresponds to the trip bar body 60 generally circular portion 61. In an exemplary embodiment, the saddle body 130 further defines a number of latching surfaces 134. As used herein, a latching surface is a surface structured to be engaged by a snap hook latch.

The bearing cap 126 includes a body 140 defining an encircling member 141 and an interface member 150. The encircling member 141 includes a bearing cap body generally planar base 142 and elongated, cantilever snap hooks 144, 146 extending from opposite ends therefrom. The cantilever snap hooks 144, 146 extend in the same direction from the bearing cap base 142. That is, the bearing cap body 140 is generally U-shaped. The snap hooks 144, 146 include a surface extending generally parallel to the plane of the bearing cap base 142. In this configuration, the bearing cap body 140 is structured to be coupled to the saddle 124 thereby defining the captivation space 122. That is, the U-shaped bearing cap body 140 is inverted and coupled in opposition, i.e. facing, the saddle body semi-circular surface 132. Thus, the bearing cap 126 is coupled, and in an exemplary embodiment, directly coupled to the first sidewall 102; in this configuration there is a limited tolerance build up. Further, the outer surface of the bearing cap base 142 includes a number of cylindrical ridges 148. The cylindrical ridges 148 engage the opposing trip unit housing assembly sidewall 104 when assembled, as described below. The cylindrical ridges 148 allow for a line contact between the trip unit housing assembly sidewall 104 and the captivation assembly 120.

The interface member 150 is sized and positioned to extend into the captivation space 122. In an exemplary embodiment, the interface member 150 includes a first surface 152, a second surface 154, and a third surface 156. Each interface member surface 152, 154, 156 is structured to engage or contact a surface on an adjacent component. In an exemplary embodiment, the interface member 150 is a generally planar, triangular extension 158 extending from the bearing cap body base 142 into the captivation space 122. The interface member first and third surfaces 152, 156 are spaced, generally planar surfaces extending generally in the plane defined by the bearing cap body snap hooks 144, 146. As discussed below, the interface member first surface 152 is structured to engage or contact the trip bar first medial axial face 90. The interface member second surface 154 is the edge surface between the spaced, generally planar, interface member first and third surfaces 152, 156. In an exemplary embodiment, when the interface member 150 is a generally triangular extension 158, the interface member second surface 154 includes a first portion 160 and a second portion 162 that are sides of the triangular extension 158. As set forth below, the interface member second surface 154 is structured to engage or contact a trip bar body longitudinal face 82, 84. In an exemplary embodiment, the interface member first portion 160 and second portion 162 are generally semi-cylindrical surfaces 164, i.e. the surfaces extend over an arc of about 180 degrees, and the interface between the interface thereof is a generally hemispherical surface 166. In this configuration, the interface member 150 will make a line contact or a point contact with the trip bar 48.

Figure 11:
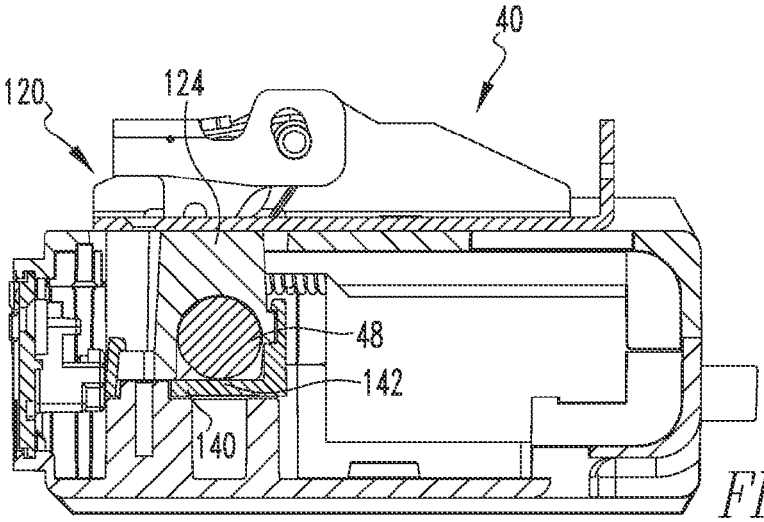
FIG. 11 is a cross-sectional view of a trip unit.

The captivation assembly 120 is assembled as follows. The trip bar body bearing surface 61 is disposed on the saddle body semi-circular surface 132. The trip bar body second end lug 78 is disposed in the first flange opening 109. In this configuration, the trip bar 48 is merely resting on the saddle 124 and is not captivated. That is, for example, the trip bar 48 may move axially away from the first flange opening 109 thereby freeing the trip bar body second end lug 78 from the first flange opening 109. As such, the trip bar 48 does not have a limited range of motion within the captivation space 122. Further, it is noted that, because the bearing cap 126 includes a body 140 that includes a generally planar base 142, the area of contact between the trip bar 48 and the bearing cap base 142 is a line or a point, as shown in FIG. 11. This configuration, i.e. the shape of the bearing cap base 142, reduces the likelihood of binding between the bearing cap 126 and the trip bar 48.

The bearing cap 126 is then coupled, directly coupled or fixed, to the saddle 124. As the bearing cap 126 is moved into place, the interface member 150 moves into the trip bar body arcuate gap 87. That is, the interface member 150 moves into the space between the trip bar body longitudinal faces 82, 84. In an exemplary embodiment, the trip bar body arcuate gap 87 extends over an arc of between about 0 and 90 degrees, or about 28 degrees. The interface member triangular extension 158 has a smaller cross-sectional area than the trip bar body arcuate gap 87 and, in an exemplary embodiment, the angle of the distal corner of the interface member triangular extension 158 is between about 0 and 30 degrees. Further, the interface member first surface 152 is disposed, in an exemplary embodiment between about 0 and 2 mm or about 1 mm from the trip bar body first medial axial face 90. The trip bar body first medial axial face 90 faces the opposite direction compared to the trip bar body second end lug 78. The bearing cap 126 is then coupled to the saddle 124 by the snap hooks 144, 146 latching to the saddle latching surfaces 134.

In this configuration, the trip bar 48 is captivated. For example, the trip bar 48 has a limited range of axial motion in that when the trip bar 48 moves toward the first flange opening 109, the trip bar body second end axial face 76 contacts or engages the first sidewall flange 106. If the trip bar 48 moves away from the first flange opening 109, the trip bar body first medial axial face 90 contacts or engages interface member first surface 152. The contact of the trip bar body first medial axial face 90 and the bearing cap interface member first surface 152 prevents the trip bar 48 from moving in a first longitudinal direction. Thus, the trip bar 48 has a limited range of axial motion. That is, the captivation assembly 120 longitudinally captivates the trip bar 48. As noted above, the disclosed configuration of the captivation assembly 120 reduces tolerance buildup. Further, the assembled configuration, wherein the captivation assembly 120 is disposed adjacent the trip latch assembly 17, further reduces tolerance buildup over the circuit breaker 10.

Further, the interface member second surface 154 is disposed in the trip bar body arcuate gap 87 adjacent the trip bar body longitudinal faces 82, 84. In this configuration, when the trip bar 48 rotates, the trip bar body longitudinal faces 82, 84 will contact or engage the interface member second surface 154. Thus, rotation of the trip bar 48 beyond a limited range is prevented by contact of the interface member second surface 154 and the trip bar body longitudinal faces 82, 84. Accordingly, the trip bar 48 has a limited range of rotational motion. That is, the captivation assembly 120 rotationally captivates the trip bar 48.

The trip unit 40 can then be assembled by coupling the various components to one of the housing assembly sidewalls 102, 104. The housing assembly sidewalls 102, 104 are then coupled to each other and, as noted above, the housing assembly sidewall 104 opposite the captivation assembly 120 engages the bearing cap base cylindrical ridges 148 thereby providing an interference fit of between about 0.005 and 0.010 inch. The trip unit 40 is then disposed within the circuit breaker housing assembly 12 and coupling the operating mechanism 16 to the trip unit 40.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A trip unit comprising:

a housing assembly including a first generally planar sidewall;

a captivation assembly disposed only on said first sidewall;
an elongated trip bar;
said trip bar captivated by said captivation assembly;
said captivation assembly includes a saddle and a bearing cap;
said bearing cap coupled to said saddle; and
said bearing cap and said saddle defining a captivation space.

2. The trip unit of claim 1 wherein said captivation assembly longitudinally captivates said trip bar.

3. The trip unit of claim 1 wherein said captivation assembly rotationally captivates said trip bar.

4. The trip unit of claim 1 wherein said captivation assembly rotationally captivates said trip bar.

5. The trip unit of claim 1 wherein:
said bearing cap includes an encircling member and an interface member;
said interface member extending into said captivation space, said interface member includes a first surface;
said trip bar including a body with a first medial axial face;
said trip bar body first medial axial face disposed immediately adjacent said bearing cap interface member first surface; and
whereby contact of said trip bar body first medial axial face and said bearing cap interface member first surface prevents said trip bar from moving in a first longitudinal direction.

6. The trip unit of claim 5 wherein:
said interface member including a second surface;
said trip bar body includes a longitudinal cut-out defining a number of longitudinal faces;
said trip bar body longitudinal faces defining an arcuate gap with a first cross-sectional area;
said interface member second surface defining a second cross-sectional area;
wherein said second cross-sectional area is smaller than said first cross-sectional area;
said interface member second surface disposed adjacent said trip bar body longitudinal faces; and
whereby said trip bar has a limited range of rotational motion, wherein rotation of said trip bar beyond said limited range is prevented by contact of said interface member second surface and said trip bar body longitudinal faces.

7. The trip unit of claim 1 wherein:
said bearing cap includes an encircling member and an interface member;
said interface member extending into said captivation space, said interface member includes a second surface;
said trip bar includes a body with a longitudinal cut-out having a number of longitudinal faces;
said trip bar body longitudinal faces defining an arcuate gap with a first cross-sectional area;
said interface member second surface defining a second cross-sectional area;
wherein said second cross-sectional area is smaller than said first cross-sectional area;
said interface member second surface disposed adjacent said trip bar body longitudinal faces; and
whereby said trip bar has a limited range of rotational motion, wherein rotation of said trip bar beyond said limited range is prevented by contact of said interface member second surface and said trip bar body longitudinal faces.

8. The trip unit of claim 1 wherein:
said saddle is unitary with said first sidewall;
said saddle includes a number of latch surfaces;
said bearing cap includes a number of snap hooks; and
said bearing cap coupled to said saddle when said snap hooks engage said number of latch surfaces.

9. The trip unit of claim 1 wherein:
said trip bar includes a body with an axis of rotation;
wherein said first sidewall includes a planar flange, said flange extending generally perpendicular to the plane of said first sidewall;
wherein said first sidewall flange spaced from said saddle and wherein the plane of said flange extends generally perpendicular to said trip bar body axis of rotation;
said first sidewall flange including an opening;
said trip bar body including a second axial end;
said trip bar body second axial end including a generally circular tug, said lug disposed at about said trip bar body axis of rotation; and
said lug rotatably disposed in said first sidewall flange opening.

10. A circuit breaker comprising:
a housing assembly defining an enclosed space;
said enclosed space including a trip unit cavity;
a trip unit including a housing assembly, a captivation assembly, and an elongated trip bar;
said trip unit housing assembly including a first generally planar sidewall;
said captivation assembly disposed only on said first sidewall;
said elongated trip bar;
said trip bar captivated by said captivation assembly;
said trip unit disposed in said trip unit cavity;
said captivation assembly includes a saddle and a bearing cap;
said bearing cap coupled to said saddle; and
said bearing cap and said saddle defining a captivation space.

11. The circuit breaker of claim 10 wherein said captivation assembly longitudinally captivates said trip bar.

12. The circuit breaker of claim 10 wherein said captivation assembly rotationally captivates said trip bar.

13. The circuit breaker of claim 10 said captivation assembly rotationally captivates said trip bar.

14. The circuit breaker of claim 10 wherein:
said bearing cap includes an encircling member and an interface member;
said interface member extending into said captivation space, said interface member includes a first surface;
said trip bar including a body with a first medial axial face;
said trip bar body first medial axial face disposed immediately adjacent said bearing cap interface member first surface; and
whereby contact of said trip bar body first medial axial face and said bearing cap interface member first surface prevents said trip bar from moving in a first longitudinal direction.

15. The circuit breaker of claim 14 wherein:
said interface member including a second surface;
said trip bar body includes a longitudinal cut-out defining a number of longitudinal faces;
said trip bar body longitudinal faces defining an arcuate gap with a first cross-sectional area;
said interface member second surface defining a second cross-sectional area;
wherein said second cross-sectional area is smaller than said first cross-sectional area;
said interface member second surface disposed adjacent said trip bar body longitudinal faces; and whereby said trip bar has a limited range of rotational motion, wherein rotation of said trip bar beyond said limited range is prevented by contact of said interface member second surface and said trip bar body longitudinal faces.

16. The circuit breaker of claim 10 wherein:

said bearing cap includes an encircling member and an interface member;

said interface member extending into said captivation space, said interface member includes a second surface;

said trip bar includes a body with a longitudinal cut-out having a number of longitudinal faces;

said trip bar body longitudinal faces defining an arcuate gap with a first cross-sectional area;

said interface member second surface defining a second cross-sectional area;

wherein said second cross-sectional area is smaller than said first cross-sectional area;

said interface member second surface disposed adjacent said trip bar body longitudinal faces; and whereby said trip bar has a limited range of rotational motion, wherein rotation of said trip bar beyond said limited range is prevented by contact of said interface member second surface and said trip bar body longitudinal faces.

17. The circuit breaker of claim 10 wherein:

said saddle is unitary with said first sidewall;

said saddle includes a number of latch surfaces;

said bearing cap includes a number of snap hooks; and said bearing cap coupled to said saddle when said snap hooks engage said number of latch surfaces.

18. The circuit breaker of claim 10 wherein:

said trip bar includes a body with an axis of rotation;

wherein said first sidewall includes a planar flange, said flange extending generally perpendicular to the plane of said first sidewall;

wherein said first sidewall flange spaced from said saddle and wherein the plane of said flange extends generally perpendicular to said trip bar body axis of rotation;

said first sidewall flange including an opening;

said trip bar body including a second axial end;

said trip bar body second axial end including a generally circular lug, said lug disposed at about said trip bar body axis of rotation; and said lug rotatably disposed in said first sidewall flange opening.

* * * * *